United States Patent [19]

Gardner et al.

[11] 4,046,175

[45] Sept. 6, 1977

[54] PRECISION LEVEL COIL WINDING APPARATUS

[75] Inventors: Alexander C. Gardner; Ronald L. Gable, both of Dayton, Ohio

[73] Assignee: Machine Products Corporation, Dayton, Ohio

[21] Appl. No.: 666,871

[22] Filed: Mar. 15, 1976

[51] Int. Cl.[2] ..... B21F 3/04

[52] U.S. Cl. ..... 140/92.1; 318/603

[58] Field of Search ..... 140/1, 92.1; 242/DIG. 1; 318/601, 603

[56] References Cited

U.S. PATENT DOCUMENTS

| | | | |
|---|---|---|---|
| 3,851,682 | 12/1974 | Vogel et al. | 140/92.1 |
| 3,881,526 | 5/1975 | Bell et al. | 140/92.2 |

*Primary Examiner*—Lowell A. Larson

*Attorney, Agent, or Firm*—Jacox & Meckstroth

[57] ABSTRACT

Apparatus for precision level winding of coils. The apparatus is particularly adapted for precision level winding of a continuous set of coils, in which each of the coils in the set may have a number of turns differently from each of the other coils in the set and may be of a length and pitch different from each of the other coils in the set.

The apparatus includes means for automatically applying coils of wire to a coil holder member which has a plurality of aligned substantially coaxial levels.

The apparatus includes control means by which each of the variables involved is readily adjustable.

There is relative axial movement between a rotary wire-laying flyer and the coil holder member. The apparatus includes means for applying a desired number of turns of wire to each level in a manner such that the spacing between turns is substantially constant, and the number turns applied to each level adjusted readily and easily.

16 Claims, 2 Drawing Figures

PRECISION LEVEL COIL WINDING APPARATUS

BACKGROUND OF THE INVENTION

This invention relates to the coil winding art and, more particularly, to control means for effecting substantially equal spacing between adjacent coil turns on a given level, regardless of the number of turns on that level.

Numerous types of apparatus have been created to wind a set of coils of wire so that each of the coils may have a different length and a different pitch. However, so far as is known, no apparatus prior to this invention has provided means by which a desired pitch of coil and the number of turns thereof can be easily and readily established by adjustment of manually operable control members.

It is an object of this invention to provide apparatus for winding a set of coils, in which each coil is wound on a different level, in which the number of turns of wire in each coil can be easily selectively established, in which the spacing between turns of a coil is substantially constant, and in which the starting point of each coil is along a substantially straight line or within a given plane.

It is another object of this invention to provide digital control means for permitting selective winding of any desired number of turns along each of one or more predetermined levels of a coil retainer member while maintaining substantially equal spacing between the turns applied to each level.

Other objects and advantages of this invention reside in the construction of parts, the combination thereof, the method of manufacture, and the mode of operation, as will become more apparent from the following description.

DETAILED DESCRIPTION OF THE APPARATUS

Figure 1:
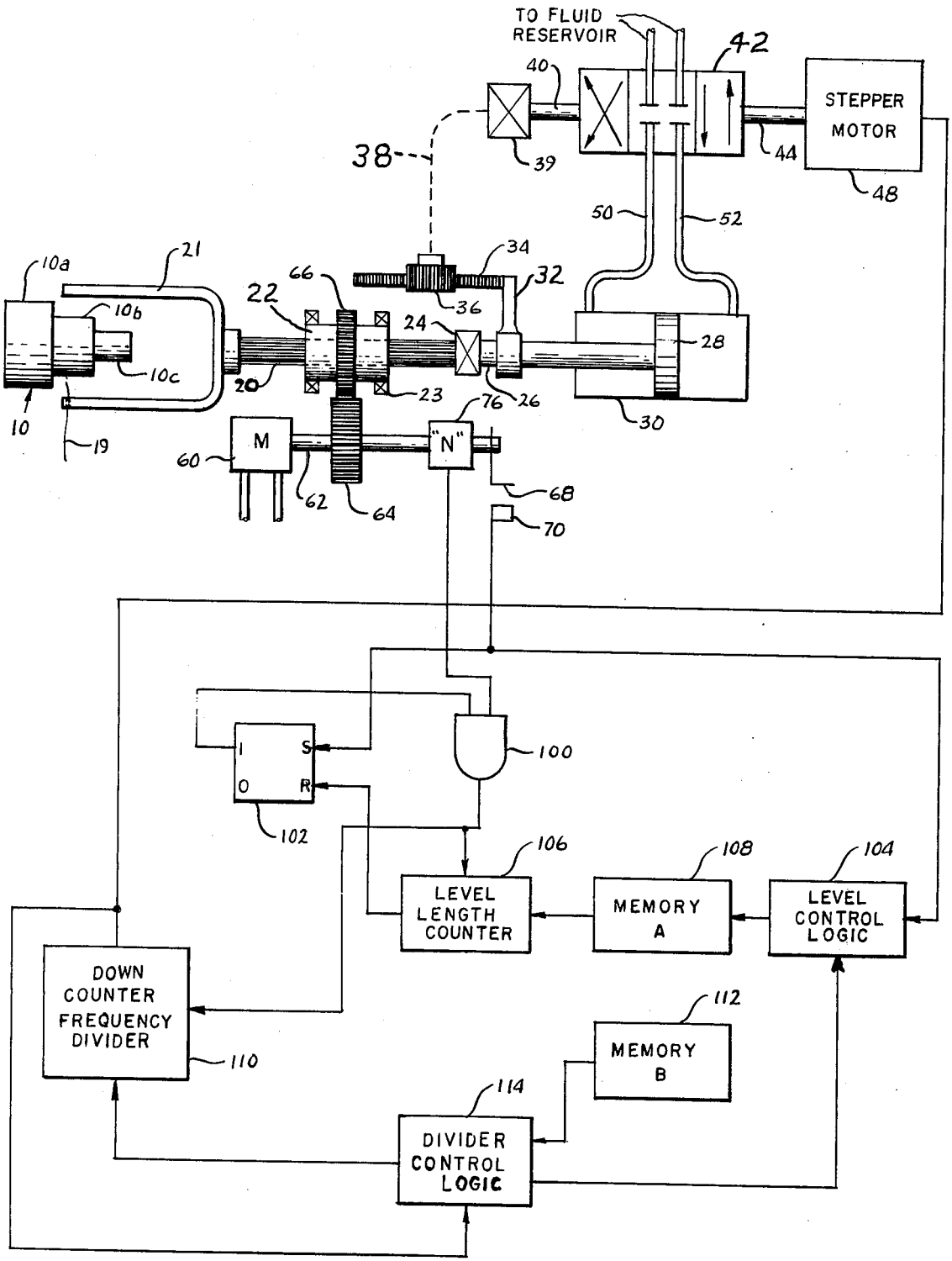
FIG. 1 is partially a diagrammatic view of a typical coil winding apparatus and partially a major block diagram of the control system therefor.

As shown in FIG. 1 of the drawing, coil winding apparatus of this invention comprises a coil holder member 10 having a plurality of graduated diameter levels 10*a*, 10*b*, and 10*c*. The coil holder member 10, as shown, is adapted to remain substantially stationary during the winding process. A rotatable shaft 20 carries a coil winding flyer 21 from which a continuous length of wire 19 extends for winding turns of the wire 19 upon the coil holder member 10. The shaft 20 is splined and is retained in a splined sleeve 22. The sleeve 22 is journalled in any suitable bearing members 23. The shaft 20 extends through the sleeve 22 and is attached by a suitable coupling 24 to a piston rod 26 which has a piston 28 attached thereto within a cylinder 30.

A bracket 32 attaches the piston rod 26 to a toothed rack 34. A toothed wheel or pinion 36 is in mesh with the toothed rack 34. Rotary linkage mechanism 38 through a coupling 39, joins the toothed wheels 36 to a rotary stem portion 40 of a servo fluid valve member 42. The servo fluid valve member 42 may be any suitable servo fluid valve apparatus. Another rotary stem portion 44 of the servo fluid valve member 42 is attached to an electrical stepper rotary motor 48. A first fluid conduit 50 extends from the servo fluid valve member 42 to one end portion of the cylinder 30, and a second fluid conduit 52 extends from the servo fluid valve member 42 to the opposite end portion of the cylinder 30.

A rotary drive motor 60 has an output shaft 62 to which is secured a gear wheel 64 which is in meshed relationship with a gear wheel 66. The gear wheel 66 encompasses the sleeve 22 for rotation thereof. The gear wheels 64 and 66 are shown as being the same diameter and having the same number of teeth and are thus of a one-to-one ratio. Attached to the shaft 62 is a finger 68 which is adapted to actuate a proximity switch 70 upon each revolution of the shaft 62 to provide top dead center and revolution count information.

For a winding operation, the piston 28 is forced axially to move the shaft 20 axially to a position in which the flyer 21 is adjacent the coil holder member 10. The flyer 21 is rotated by the drive motor 60 to lay continuous material, such as wire 19, in the form of a coil upon the level 10*a*. During this winding procedure, the shaft 20 and the flyer 21 are moved axially by the piston 28, as well as rotatively by the drive motor 60. The level 10*a* of the coil holder member 10 is of a given length and the number of turns or convolutions of the wire 19 to be laid upon the level 10*a* is predetermined. The predetermined number of turns or convolutions of the wire 19 are laid upon the level 10*a* in such a manner that, when completed, the coil upon the level 10*a* extends the length of the level 10*a*, and there is substantially equal spacing between the turns of the coil on the level 10*a*.

Then the flyer 21 moves at a high rate of speed axially to the level 10*b*, before the flyer 21 rotates past the starting point for the first turn on the level 10*b*. Then rotation and axial movement of the shaft 20 and the flyer 21 resumes as the continuous wire is laid in the form of a coil of one or more turns upon the level 10*b*. Then after a predetermined number of equally spaced turns are wound upon the level 10*b*, the flyer 21 axially moves from the level 10*b* to the level 10*c*, so that the starting point of the coil wound on the level 10*c* is in alignment with the starting point of the coil wound on the level 10*b*. Then winding of the wire 19 upon the level 10*c* is effected in the manner discussed above, as a predetemined number of equally spaced turns of the continuous wire 19 are wound upon the level 10*c*. The position at which the flyer 21 is moved axially at high speed, from each level to the next level may be a top dead center position or may be any other rotative position of the flyer 21.

More than one layer of turns of the continuous material may be applied to each level of the coil holder member 10 by the apparatus of this invention. THe continuous material wound in each layer on each level is effected in the manner discussed above.

The control circuitry includes means by which the stepper motor 48 rotatively moves a predetermined number of pulse steps corresponding to the axial length of each level of the coil holder member 10. Each pulse step of the stepper motor 48 permits a predetermined quantity of fluid to flow from the fluid reservoir through the servo fluid valve member 42 to the cylinder 30 for axial movement of the piston 28 a predetermined distance, thus axially moving the flyer 21 a predetermined axial distance. The rack 34 is moved axially with the piston rod 26, and the pinion 36 rotates with axial movement of the rack 34. The pinion 36 rotates the linkage mechanism 38 which rotates the stem portion 40, which moves an internal portion of the servo fluid valve member 42 in accordance with axial movement of the flyer 21. Thus, the servo the servo fluid valve member 42 responds to axial movement of the flyer 21 and permits the proper volume of fluid to flow therethrough to axially move the flyer 21 the distances predetermined by the control circuitry of the invention, in a manner discussed below. A pulse generator 76 is directly coupled to the shaft 62 and is adapted to issue "N" reference pulses per revolution of the shaft 62.

The reference pulses from the pulse generator 76 are applied to one input of an AND-Gate 100 which has its other input connected to the "1" output from a flip-flop 102. The flip-flop 102 is set each time a top dead center pulse is received from the proximity switch 70 because each top dead center pulse is applied to the set input of the flip-flop 102. Each top dead center pulse is also applied to level control logic 104 which monitors the number of turns wound on each level of the coil holder member 10 and issues control information to a first memory 108. The first memory 108 utilizes the information received from the level control logic 104 to issue output signals to a level length counter 106, which output signals determine the number of reference pulses per revolution of the shaft 62 which are permitted to pass through the AND-Gate 100. When the level length counter 106 has reached a prescribed number of pulses, it issues a "count complete" output signal which is applied to the reset input of the flip-flop 102. The flip-flop 102 responds by assuming the reset state to disable the AND-Gate 100 which therefore can pass no more reference pulses until the next succeeding top dead center pulse again sets the flip-flop 102.

However, during the period the AND-Gate 100 is fully enabled, the reference pulses are also applied to a decrement input of a down-counter frequency divider 110. Since the frequency divider 110 is of the down count type, it is necessary to preset a count into it each time it counts to zero. The count to which the down-counter frequency divider 110 is preset is governed by information received from divider control logic 114 which, in turn, responds to information received from a second memory 112. The second memory 112 contains information about the number of turns to be laid down on each level of the coil holder member 10. It may be noted that, with respect to both the first memory 108 and the second memory 112, the term "memory" is used in its most generic sense. By way of example, the first memory 108 is typically an electronic read-only memory whereas the second memory 112 may be mechanical (thumb wheels or the like) by which an operator may enter information for a specific set of windings as a part of the machine set-up procedure.

The output from the frequency divider 110 is applied to the stepper motor 48 as a series of increment pulses which is a submultiple of the pulses received from the reference pulse generator 76, but only for a portion of each revolution of the shaft 62. Each increment pulse is also applied back to the divider control logic 114 as a zero count reset which instructs the divider control logic 114 to again preset the down-counter frequency divider 110 to the appropriate count for the particular level of the coil holder member 10 being wound.

Information from the divider control logic 114 is also applied back to the level control logic 104 in order that the level control logic will sense the appropriate number of top dead center pulses for each level of the coil holder member 10 and will step to the next level thereof to provide a corresponding new output to the first memory 108 at the time of a level change.

Figure 2:
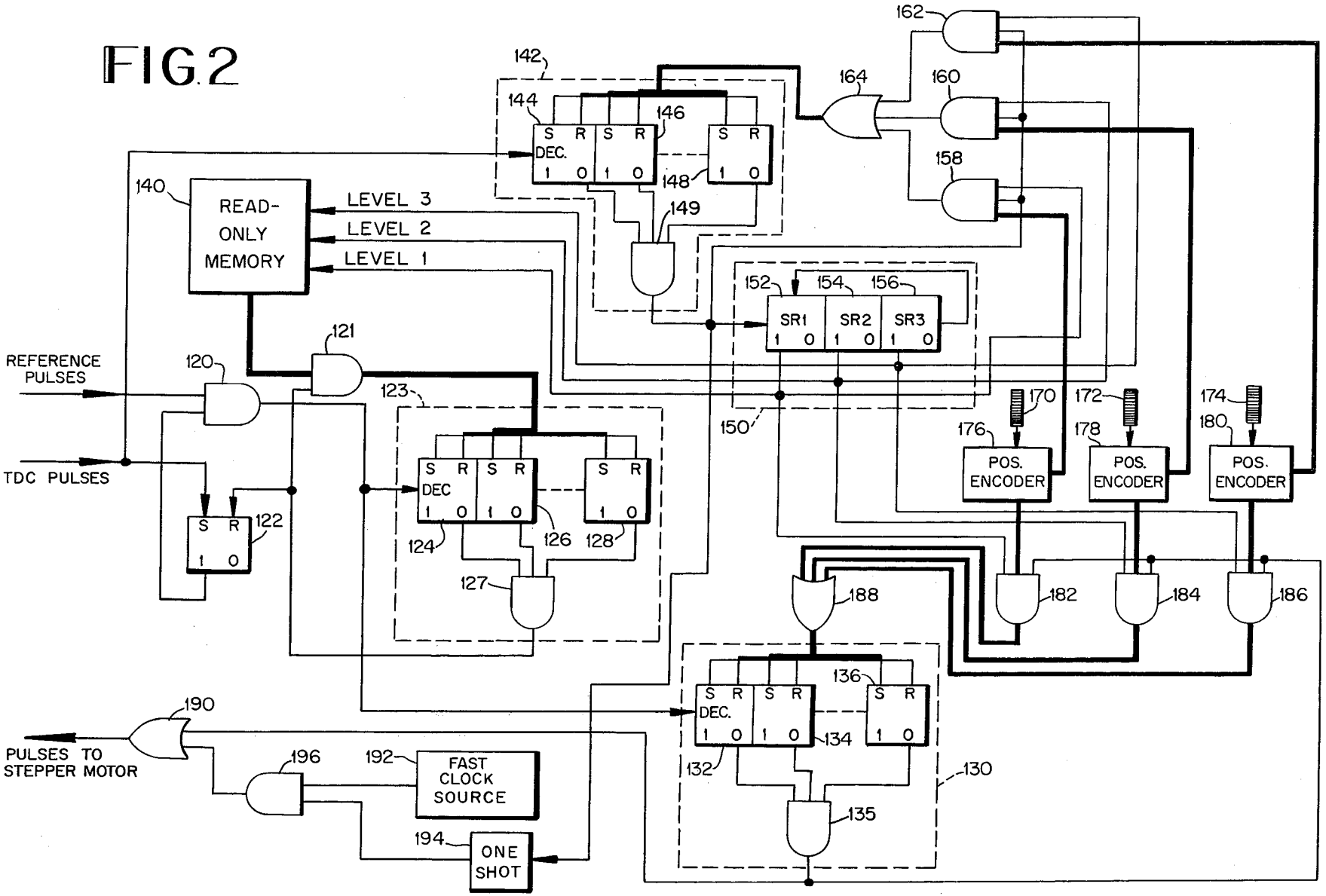
FIG. 2 is an intermediate logic block diagram of the control system for operation of the apparatus.

Attention is now directed to FIG. 2 which is a more detailed logic block diagram illustrating the control system of the present invention.

The logic diagram FIG. 2 is presented in slightly simplified form in order that the inventive concepts may be readily understood. For example, instantaneous response times are assumed such that no special logic is shown for overcoming logic race conditions which occur in practice as speed is increased until the circuits cannot be assumed to respond simultaneously and immediately. In addition, the most straightforward, completely positive logic is employed. The changes and additions required to overcome logic race conditions and other problems associated with high speed operation, as well as the means by which different logic families can be employed to realize the basic logic scheme, are known to all skilled in the art and are of no consequence to an understanding of the invention.

An AND-Gate 120, corresponding to the AND-Gate 100 of FIG. 1, receives the reference pulses on one input leg thereof. THe second input leg of the AND-Gate 120 is connected to the "1" output of a flip-flop 122 which corresponds to the flip-flop 102 of FIG. 1. The flip-flop 122 is set by each top dead center pulse applied to its set input to fully enable the AND-Gate 120. The output from the AND-Gate 120 is applied to the decrement inputs of first and second presettable downcounters 123 and 130 comprising, respectively, binary stages 124, 126 and 128, and binary stages 132, 134 and 136. It will be apparent to those skilled in the art that each of these counters may include as many binary stages as may be necessary to hold the largest number by which the reference pulses passing through the AND-Gate 120 is to be divided by each counter.

The "0" output from each of the binary stages 124, 126 and 128 is applied to corresponding input legs of an AND-Gate 127. Thus, it is apparent that the AND-Gate 127 is only fully enabled when all stages of the down-counter 123 are "0", and the resultant output pulse is applied to the reset input of flip-flop 122 which responds by assuming the reset state to disable the AND-Gate 120. As a result, no additional reference pulses are permitted to pass through the AND-Gate 120 until the next succeeding top dead center pulse again sets the flip-flop 122.

The number to which the down-counter 123 is preset depends upon information stored in and supplied from a read-only memory 140. THe read-only memory 140 is addressed by signals representing level **10*a*, level 10*b*, and level 10*c* of the coil holder member 10 (for the exemplary three level apparatus). For example, when the level 10*a* address is applied to the read-only memory 140, a predetermined and prestored number is read from the read-only memory 140 and applied through an AND-Gate array 121 to the set and reset inputs of the binary stages 124, 126 and 128 in the binary pattern corresponding to the number of reference pulses represented by the physical length of the level 10*a*. Thus, if the level 10*a* is 380 reference pulses "long", a binary number representing decimal 380 is entered into the binary stages 124, 126, (intermediate stages not shown), and 128, such that the pulses received from the AND-Gate 120 cause the counter 123 to count down from this number to zero in order to fully enable the AND-Gate 127, which resets the flip-flop 122 as previously noted and also enables the AND-Gate array 121 to again preset the counter 123. In this example, the counter 123 would have to be at least eight stages long since eight binary digits are necessary to express the decimal number 380.**

The level addresses supplied to the read-only memory 140 are obtained in the following manner. The top dead center pulses are also applied to the decrement input of a third presettable down-counter 142 comprising binary stages 144, 146 and 148. The "O" outputs from each of the binary stages in the counter 142 are applied to the inputs of an AND-Gate 149 which is therefore fully enabled only when the total count in the counter 142 reaches zero. The output from the AND-Gate 149 is applied to the first stage of a shift register 150 comprising three binary stages 152, 154, and 156. The shift register 150 is configured to shift a "1" bit from stage to stage each time the AND-Gate 149 is fully enabled. The "1" output from the binary stage 152 of the shift register 150 is applied to the level 1 address input of the readonly memory 140. Similarly, the "1" outputs from the stages 154, and 156 of the shift register 150 are coupled, respectively, to the level **10*b* and level 10*c* address inputs of the read-only memory 140. It will be noted that an output from the third stage 156 of the shift register 150 is connected back to an input of the first stage 152 in order to keep the "1" bit circulating; i.e., after level 3 is addressed, level 1 is next addressed. Thus, the shift register 150** serves as a "memory" for indicating the current winding level.

The "1" outputs from the binary stages 152, 154, and 156 of the shift register 150 are also connected, respectively, to first inputs to AND-Gate arrays 158, 160, and 162. First inputs to each of the AND-Gate arrays 158, 160, and 162 are driven by the output from the AND-Gate 149. The outputs from the AND-Gate arrays 158, 160, and 162 drive respective inputs to an OR-Gate array 164, and the output signals from the OR-Gate array 164 are applied to the several binary stages 144, 146, and 148 of the third presettable down-counter 142 in order to preset the downcounter 142 to the number of turns plus one in the level currently being wound. Thus it will be understood that the number of which the down-counter 142 is preset depends upon which one of the AND-Gate arrays 158, 160, and 162 is enabled when the AND-Gate 149 issues an output pulse indicating that it is again time to preset the counter. The specific one of the AND-Gate arrays 158, 160, and 162 enabled therefore depends upon the stage of the shift register 150 in which the "1" bit is currently situated. Turn number information is applied to the AND-Gate arrays 158, 160, and 162 in binary words having a length corresponding to the number of stages actually in the counter 142. Three sets of thumb wheels 170, 172, and 174 are provided by which an operator can enter the number of turns which are to be wound on each level of the coil form holder 10. The three sets of thumb wheels 170, 172, and 174 are coupled, respectively, to position encoders 176, 178, and 180. The position encoders 176, 178, and 180 respond to the physical position of the thumb wheels 170, 172, and 174 to generate binary words by employing, for example, multiple switches coupled to the thumb wheels and driving suitable diode decoders or the equivalent. By way of example, if level **10*b* of the coil holder member 10 is to contain nine turns, the position of thumb wheel 172 is so set, and the position encoder 178 responds by issuing the binary word 1001 to the AND-Gate array 160, and this quantity is entered into the counter 142 when the shift register 150 steps from level 10*a* to level 10*b*.**

It is also necessary that the counter 130 be preset in accordance with the number of turns to be wound on each level of the coil holder member 10. Thus, the information from the position encoders 176, 178, and 180 is also applied to AND-Gate arrays 182, 184, and 186. The respective outputs from the AND-Gates arrays 182, 184, and 186 are applied to the inputs to an OR-Gate array 188, and the output signals from the OR-Gate array 188 drive the respective set and reset inputs to the several stages of the counter 130.

In a manner similar to the operation already described in conjunction with the counters 123 and 142, when the counter 130 is decremented to a count of zero by reference pulses from the AND-Gate 120, the AND-Gate 135 becomes fully enabled and issues an output pulse which is applied to one input of an OR-Gate 190 from which an increment pulse is issued to the stepper motor 48 as shown in FIG. 1. The output pulse from the AND-Gate 135 is also applied to each of the gates in the AND-Gate arrays 182, 184, and 186. In addition, the "1" output from the first stage of the shift register 150 is applied to the remaining inputs of the AND-Gates in the array 182. Similarly, the "1" outputs from the second and third stages of the shift register 150 are applied to the remaining inputs of AND-Gates of the arrays 184 and 186, respectively. Thus, it will be seen that only the information from the AND-Gate array corresponding to the level at which the winding operation is occurring is entered into the counter 130 each time the counter 130 reaches a count of zero which enables the AND-Gate 135 to indicate a necessity for again presetting the counter 130.

At the beginning of an operation, the operator enters the turns to be wound on each of the respective three levels of the coil holder member 10 in the corresponding sets of thumb wheels 170, 172, and 174. After initialization (by conventional circuits not shown), the counters 142 and 130 will contain the binary representation of the number of turns indicated by the thumb wheel 170, and the counter 123 will have been preset to the number extracted from the read-only memory 140 corresponding to the length in pulses of the first level. On the next succeeding top dead center pulse, the flip-flop 122 will be set to fully enable the AND-Gate 120 which therefore commences to pass the reference pulses by which the counters 123 and 130 are decremented. In addition, the top dead center pulse is applied to the counter 142 to decrement it by a count of one. As the counter 130 is decremented, it will repeatedly reach a count of zero and be reset, thereby issuing increment pulses through the OR-Gate 190 to the stepper motor 48. Similarly, the counter 123 is decremented by the reference pulses, but since it typically contains a much larger binary number than the couner 130, the counter 130 counter cycle many times for each cycle of the counter 123 which results in a reset pulse issued to the flip-flop 122. Thus, it will be seen that the increment pulses to the stepper motor 48 are present during the first portion of each revolution, but may not be, and typically are not, present during the terminal portion of each revolution.

As previously noted, each top dead center pulse also decrements the counter 142, and when the counter 142 reaches a count of zero, the shift register 150 is advanced to indicate that level **10*b* is now to be wound. Thus, the number of turns established in the thumb wheel 172** is now entered in binary form to the counters 130 and 142, and the level 10*b* address is made to the read-only memory 140 to extract the number representing the length in pulses of level 10*b*, and this information is entered into the counter 123. Upon the detection of the next top dead center pulse, the flip-flop 122 is again set to initiate winding on level 10*b*. When level 10*b* winding is completed, level 10*c* is wound in the same manner.

It will be noted that a rapid axial translation of the winding flyer 21 may be desirable when shifting from one level to another. This function may be carried out by coupling the output of the AND-Gate 149, from which a pulse issued to signify the end of a level, to a one-shot multivibrator circuit 194. The output from the one-shot circuit 194 is utilized to enable one leg of an AND-Gate 196. The other input to the AND-Gate 196 receives fast clock pulses from a fast clock source 192. Thus, for a predetermined period of time corresponding to the time out of the one-shot multivibrator circuit 194, fast clock pulses appear at the output of AND-Gate 196 which drives an input of the OR-Gate 190 from which increment pulses are applied to the stepper motor 48. Several functional equivalents to the one-shot circuit 194 will occur to those skilled in the art.

Consider an example in which the maximum allowable axial length for a given level is 600 increment pulses, each such increment pulse causing the stepper motor 48 to rotatively index 0.9° (400 pulses per revolution). Thus, the reference pulse generator 76 should issue 600 pulses for each revolution of the shaft 62. Now, suppose the actual length of a specific level to be wound is 380 pulses and it is desired to wind eight turns including one turn for the high speed transition between levels. The counter 142 will be present to eight, the counter 130 will be preset to seven and the counter 123 will be preset to 380, all in straight binary representation. Upon th occurrence of the next top dead center pulse, the count in the counter 142 will be decremented to seven, and the reference pulses will begin decrementing both the counters 130 and 123. Since the counter 130 is effectively dividing by seven, 54 increment pulses will be issued to the stepper motor 48 before the count in the counter 123 reaches zero to inhibit further transfer of reference pulses through the AND-Gate 120. However, it is important to note that the counter 130 holds a remainder of two. Thus, after the next top dead center pulse again enables the AND-Gate 120, the counter 130 will preset after an initial two reference pulses have been received before again dividing by seven. After the second turn, a remainder of four will be left in the counter 130; and after the third turn, a remainder of six. But the fourth turn will actually issue 55 increment pulses and leave a remainder of one. It will therefore be seen that the down-counter 130 serves to ensure that no single revolution of the wound coil deviates more than one increment pulse equivalent length from its nominal position, therefore avoiding any excess cumulative error without the necessity for performing supplementary calculations each revolution.

While the principles of the invention have now been made clear in an illustrative embodiment, there will be immediately obvious to those skilled in the art many modifications of structure, arrangements, the elements, and components used in the practice of the invention which are particularly adapted for specific environments and operating requirements without departing from those principles.

The invention having thus been described, the following is claimed:

1. In a coil winding system adapted to provide incremental axial movement during mutual rotation and relative axial movement of a wire-laying device and a coil holder member, apparatus for effecting and controlling the incremental axial movement comprising:

A. motive means responsive to an increment input pulse for effecting a predetermined relative axial movement between the wire-laying device and the coil holder;

B. reference pulse generating means adapted to issue a predetermined number of reference pulses with each revolution of mutual rotation between the wire-laying device and the coil holder;

C. radial position pulse generating means adapted to issue a radial position pulse at a predetermined radial position during each revolution of mutual rotation between the wire-laying device and the coil holder;

D. a first memory for storing a binary representation of the length of a predetermined section of the coil holder;

E. a second memory for storing a binary representation of the number of turns to be laid on said predetermined section of the coil holder;

F. a first presettable counter adapted to receive the binary representation from said first memory and to be selectively preset thereby, said first counter further including a count input;

G. first decoding means connected to sense the count in said first presettable counter and responsive to a predetermined count therein for issuing an output pulse;

H. bistable means having first and second stable states, said bistable means being connected to said first decoding means and responsive to an output pulse therefrom for assuming said second state;

I. first gating means having an output, a first input connected to receive said reference pulses and a second input coupled to said bistable means whereby said reference pulses appear at the output of said gating means only when said bistable means is in said first state;

J. a second presettable counter adapted to receive the binary representation from said second memory and to be selectively preset thereby, said second counter including a count input;

K. second decoding means connected to sense the count in said second presettable counter and responsive to a predetermined count therein for issuing an output pulse;

L. second gating means having an output, a first input connected to receive the binary representation from said second memory, and a second input coupled to receive the output pulse from said second decoding means whereby said binary representation from said second memory is preset into said second presettable counter after said second decoding means issues an output pulse;

M. means coupling the output from said first gating means to said count input of said first presettable counter;

N. means coupling the output from said first gating means to said count input of said second presettable counter; and O. means coupling the output of said second decoding means to said motive means whereby repetitive output pulses from said second decoding means serve as increment input pulses thereto.

2. The coil winding system of claim 1 in which said second memory comprises manually operable means for selecting a number of turns to be wound on said predetermined section and a position encoder for translating the position of said manually operable means into the binary representation of the number of turns.

3. The coil winding system of claim 2 in which the coil holder has multiple predetermined sections at different levels, said system further comprising:

A. a plurality, corresponding in number to the number of levels on the coil holder, of manually operable means and corresponding position encoder for selecting the number of turns to be wound on each level;

B. a third presettable counter adapted to receive the binary representation from a selected one of said position encoders corresponding to the next level to be wound and to be preset thereby, said third counter having a count input;

C. a third memory for storing an indication of the next level to be wound, said third memory including an advance input;

D. third gating means responsive to the indication stored in said third memory for transferring the binary representation from only the position decoder corresponding to the next level to be wound to said third presettable counter;

E. means coupling a representation of the indication stored in said third memory to said first memory for addressing said first memory to issue a binary representation of the length of the next level to be wound;

F. third decoding means connected to sense the count in said third presettable counter and responsive to a predetermined count therein for issuing an output pulse;

G. means coupling said radial reference pulse to said count input of said third presettable counter;

H. means coupling said output pulse from said third decoding means to said advance input of said third memory whereby the level indication stored in said third memory is advance when a pulse issues from said third decoding means; and I. means included in said second gating means responsive to the indication stored in said third memory for transferring the binary representation from only the position encoder corresponding to the next level to be wound to said second presettable counter.

4. The coil winding system of claim 3 in which said thrid memory comprises a circularly configured shift register.

5. The coil winding system of claim 3 in which each of said first, second, and third presettable counters comprise a down-counter, and each count input comprises a decrement input.

6. The coil winding system of claim 5 in which each of said first, second and third decoding means are connected to issue an output pulse when the corresponding one of said down-counters reaches a count of zero.

7. The system of claim 6 which further includes a fast clock source and means or selectively applying fast clock pulses therefrom as fast increment pulses to said motive means to effect accelerated axial movement between the wire-laying flyer and the coil holder member.

8. The coil winding system of claim 7 which further includes timing means coupled to said third decoding means and responsive thereto for issuing a timing pulse of a predetermined period, and third gating means responsive to the presence of said timing pulse to controllably issue fast clock pulses from said fast clock source to said motive means.

9. In a coil winding system adapted to provide incremental axial movement during mutual rotation of a wirelaying device and a coil holder member having a given length in response to increment pulses, means for generating the increment pulses comprising:

A. reference pulse generating means adapted to issue a predetermined number of reference pulses during each full revolution of mutual rotation between the wire-laying device and the coil holder member;

B. radial position pulse generating means adapted to issue an indicator pulse at a predetermined radial position during each revolution of mutual rotation between the wire-laying device and the coil holder member;

C. counting means responsive to the occurrence of the indicator pulse for passing a predetermined fraction of the total number of reference pulses issued during a single revolution of mutual rotation between the wire-laying device and the coil holder member; and D. memory means for storing a binary representation of the length of the coil holder member and for storing a binary representation of the number of turns to be laid on said coil holder member, E. frequency divider means responsive to said memory means and coupled to receive reference pulses from said counting means for frequency division thereof in accordance with the number of turns to be wound on the coil holder member for generating the increment pulses in accordance with the length of the coil holder member.

10. In a coil-winding system adapted to provide axial movement during mutual rotation of a wire-laying device and a coil holder member having a given length, means for controlling the axial movement comprising:

A. motive means responsive to an input pulse for effecting a predetermined axial translation between the wire-laying device and the coil holder member;

B. a source of reference pulses synchronized to the mutual rotation between the wire-laying device and the coil holder member and adapted to issue a predetermined number of reference pulses for each full revolution of mutual rotation therebetween;

C. memory means for storing a binary representation of the length of the coil holder member and for storing a binary representation of the number of turns to be laid on said coil holder member, D. frequency divider means responsive to said memory means for receiving reference pulses and for performing frequency division thereon in accordance with the number of turns to be wound on said coil holder member for generating input pulses to said motive means; and E. length control means responsive to said memory means and interposed between said source of reference pulses and said frequency divider means for passing a predetermined fraction of said reference pulses during each revolution of mutual rotation between the wire-laying device and the coil holder member in accordance with the length of the coil holder member.

11. A coil winding system of the type having a coil holder member provided with a given length, a wire-laying device coaxially disposed with respect to said coil holder member, motor means for effecting mutual rotation between said coil holder member and said wire-laying device, linear translation means responsive to an input pulse for effecting a predetermined amount of mutual axial movement between said coil holder member and said wire-laying device, the combination comprising:

A. memory means for storing a binary representation of the length of the coil holder member and for storing a binary representation of the number of turns to be laid on said coil holder member, B. reference pulse generating means coupled to said motor means and adapted to issue a predetermind number of reference pulses during each full revolution of mutual rotation between said wire-laying device and said coil holder member;

c. radial position pulse generating means adapted to issue an indicator pulse at a predetermined radial position during each revolution of mutual rotation between said wire-laying device and said coil holder member;

D. counting means responsive to the occurrence of said indicator pulse for passing a predetermined fraction of the total number of reference pulses issued during a single revolution of mutual rotation between said wire-laying device and said coil holder member;

E. frequency divider means responsive to said memory means and coupled to receive reference pulses from said counting means for performing frequency division thereon by a factor representative of the number of turns to be wound on said coil holder member;

F. means coupling the frequency divided pulses from said frequency divider means as input pulses to said linear translation means in accordance with the length of said coil holder member.

12. The coil winding system of claim 11 in which said counting means comprises a first presettable counter and further including means to preset said first presettable counter after it has counted a predetermined number of reference pulses.

13. The coil winding system of claim 12 in which said frequency divider comprises a second presettable counter and further including means to preset said second presettable counter after it has counted a predetermined number of reference pulses.

14. The coil winding system of claim 13 which includes memory means for storing the numbers to which each of said first and second presettable counters are preset.

15. The coil winding system of claim 14 in which said memory means comprises first and second memories, at least one of said first and second memories further including means for altering the information stored thereby.

16. The coil winding system of claim 15 in which said coil holder member includes a plurality of axially-spaced coil-winding receiving sections and in which said first and second memories each include a plurality of separately addressable storage areas, said system further comprising means corresponding to the section being wound for addressing corresponding ones of said separately addressable storage areas in each of said memories whereby individually selected numbers of turns can be wound on each of said coil winding receiving sections which sections may be of diverse lengths.

* * * * *

UNITED STATES PATENT OFFICE

CERTIFICATE OF CORRECTION

Patent No. 4,046,175 Dated September 6, 1977

Inventor(s) Alexander C. Gardner and Ronald L. Gable

It is certified that error appears in the above-identified patent and that said Letters Patent are hereby corrected as shown below:

Column 5, lines 20 and 21, change "rea-donly" to ---read-only---.

Column 5, line 43, change "of" to ---to---.

Column 6, line 56, change "couner" to ---counter---;
Same line 56, "counter cycle" to read -- will cycle --.

Column 7, line 34, change "present" to ---preset---.

Column 7, line 37, change "th" to ---the---.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*